US007147435B2

(12) United States Patent
Lien et al.

(10) Patent No.: US 7,147,435 B2
(45) Date of Patent: Dec. 12, 2006

(54) FAN FASTENING DEVICE

(75) Inventors: Chun-Yi Lien, Panchiao (TW); Chi-Hao Kang, Tainan Hsien (TW); Sheng-Fu Hsu, Chung Ho (TW)

(73) Assignee: Quanta Computer Inc., Taoyuan Shien (TW)

( * ) Notice: Subject to any disclaimer, the term of this patent is extended or adjusted under 35 U.S.C. 154(b) by 149 days.

(21) Appl. No.: 10/952,927

(22) Filed: Sep. 30, 2004

(65) Prior Publication Data

US 2005/0238494 A1 Oct. 27, 2005

(30) Foreign Application Priority Data

Apr. 22, 2004 (TW) ..... 93206240 U

(51) Int. Cl.
*F04D 29/52* (2006.01)

(52) U.S. Cl. ..... 415/213.1; 415/214.1

(58) Field of Classification Search ..... 415/213.1, 415/214.1; 361/695
See application file for complete search history.

(56) References Cited

U.S. PATENT DOCUMENTS 6,520,250 B1 * 2/2003 Lee et al. ..... 165/121
6,592,327 B1 * 7/2003 Chen et al. ..... 415/213.1

* cited by examiner

*Primary Examiner*—Ninh H. Nguyen
(74) *Attorney, Agent, or Firm*—Rabin & Berdo, PC

(57) ABSTRACT

A fan-fastening device for fastening a fan is described, in which the fan has a plurality of apertures in both sides. The fan-fastening device comprises a fan clipper having a plurality of protrusions, in which the protrusions go through the apertures of the fan to attach the fan clipper to one side of the fan. The fan clipper further has a pressing part. By pressing the pressing part, the protrusions of the fan clipper are removed from the apertures of the fan, so the fan clipper is detached from the fan.

14 Claims, 2 Drawing Sheets

FAN FASTENING DEVICE

RELATED APPLICATIONS

The present application is based on, and claims priority from, Taiwan Application Serial Number 93206240, filed Apr. 22, 2004, the disclosure of which is hereby incorporated by reference herein in its entirety.

FIELD OF THE INVENTION

The present invention relates to a fan-fastening device, and more particularly, to a fan clipper that can fix and pull out a fan.

BACKGROUND OF THE INVENTION

With the progress in technology and regarding the concern of portability and practicality, present electronic products tend to be light, thin, short, and small. Therefore, the free space in electronic products is limited.

In electronic products having broad applications, a heat-dissipating fan device is commonly used in all kinds of industrial equipment. Four standard fastening holes, conventionally in the two sides of a fan, function by being penetrated with four screws accompanied by some iron fragments. However, those screws and iron fragments not only waste space, but also make the installation and maintenance of the fans troublesome.

SUMMARY OF THE INVENTION

An objective of the present invention is to provide a fan-fastening device. No screw is needed to fix the fan so that the free space can be used efficiently.

Another objective of the present invention is to provide a fan-fastening device for which the manner of securing the fan is easy so that the fan can be easily installed and removed.

According to the aforementioned objectives, the present invention provides a fan-fastening device for fastening a fan, in which the fan has a plurality of apertures in both sides. The fan-fastening device comprises a fan clipper having a plurality of protuberances, in which the protuberances go through the apertures of the fan to attach the fan clipper to one side of the fan. The fan clipper further comprises a pressing part. By pressing the pressing part, the protuberances of the fan clipper are removed from the apertures of the fan, so the fan clipper is detached from the fan.

According to the aforementioned objectives of the present invention, the present invention provides a fan module comprising a fan and a plurality of fan-fastening devices. A plurality of apertures is located in both sides of the fan, respectively. The fan-fastening devices comprise a plurality of protuberances to go through the apertures of the fan and attach the fan-fastening device to both sides of the fan. The fan-fastening device further comprises a pressing part. By pressing the pressing part to deform the fan-fastening device, the protuberances of the fan-fastening device are removed from the apertures of the fan to detach the fan-fastening device from the fan.

According to the aforementioned objectives of the present invention, the present invention provides a fan-fastening device comprising a plurality of fan clippers having a plurality of fixed frames to fix the fan clippers to two sides of a fan, in which the fixed frames of the fan clippers are protuberances and the protuberances go through the apertures of the fan to attach the fan clippers to two sides of the fan. The fan clippers comprise a plurality of pressing parts for deformation by pressing the pressing parts so that the fan clippers are detached from the fan.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

In order to make the illustration of the present invention more explicit and complete, the following description is stated with reference to the accompanying drawings.

Figure 1:
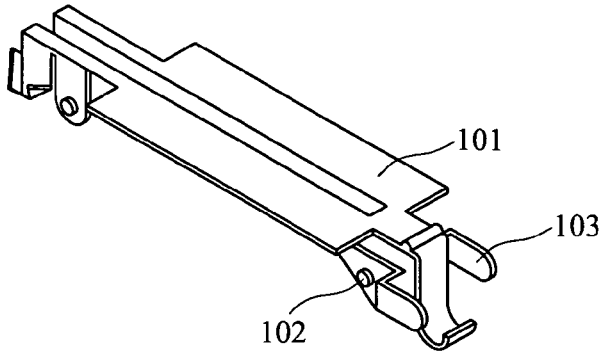
FIG. 1 is a three-dimensional schematic drawing of the fan fastening device in accordance with the preferred embodiment of the present invention.

FIG. 1 illustrates the three dimensional schematics of the fan-fastening device according to the preferred embodiment of the present invention. As shown in FIG. 1, the fan clipper 101 has protuberances 102 through the apertures of the fan to imbed the fan clipper 101 into the upper and downward sides of the fan. The material of the fan clipper 101 can be plastic. Further, the fan clipper 101 has two pressing parts 103 in one side, which are deformed by pressing. The pressing parts 103 extend outwards from the fan clipper 101. In the preferred embodiment of the present invention, the fan clipper 101 has four protuberances.

Figure 2A:
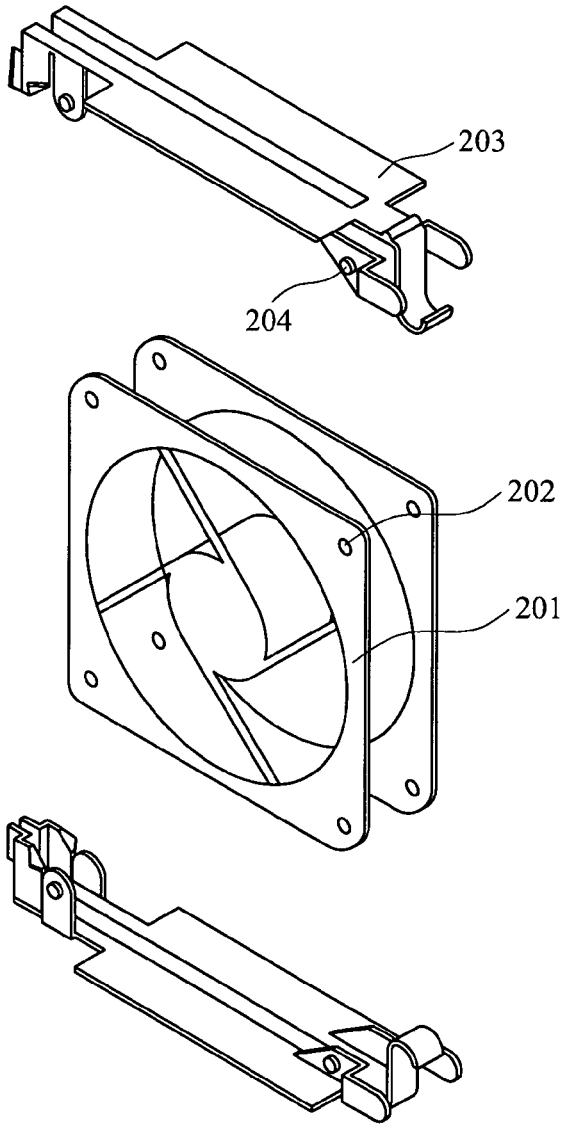
FIG. 2*a* is a three-dimensional schematic drawing of a fan module before assembly according to the preferred embodiment of the present invention.

Reference is made to FIG. 2*a*, which is a three-dimensional schematic drawing of a fan module before assembly according to the preferred embodiment of the present invention. The fan module includes a fan 201 and two identical fan clippers 203. As shown in FIG. 2*a*, when the fan 201 is installed, the fan clippers 203 are added to the upper and downward sides of the fan 201, respectively, in the preferred embodiment of the present invention. Protuberances 204 of the fan clipper 203 go through the apertures 202 of the fan 201 to attach the fan clipper 203 to the upper and downward sides of the fan 201.

Figure 2B:
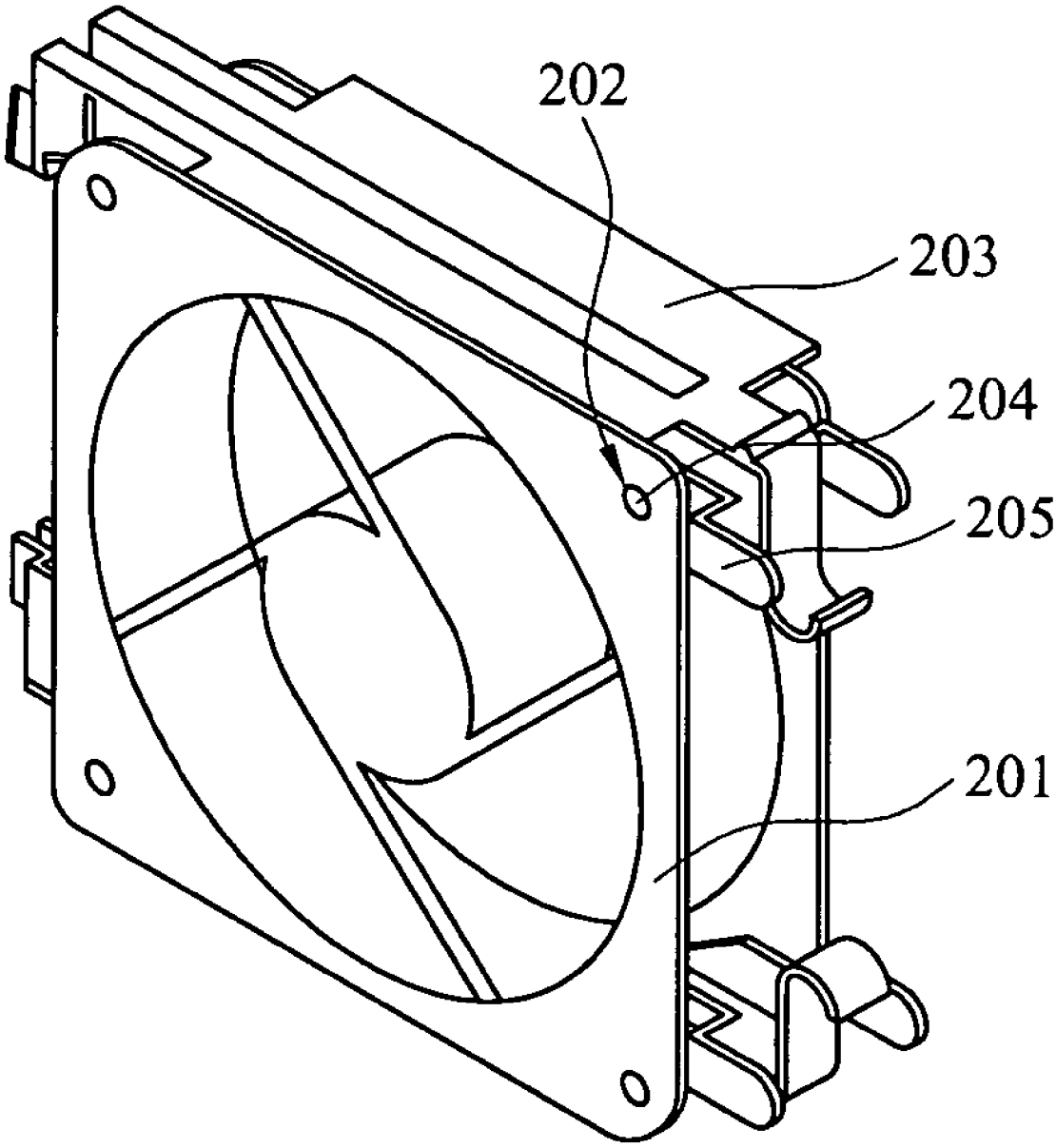
FIG. 2*b* is a three-dimensional schematic drawing of a fan module after assembly according to the preferred embodiment of the present invention.

Reference is made to FIG. 2*b*, which is a three-dimensional schematic illustration of a fan module after assembly according to the preferred embodiment of the present invention. The fan clipper 203 includes two pressing parts 205. The pressing parts 205 extend outwards from the fan clipper 203. By pressing the pressing parts 205 to deform the fan clipper 203, the protuberances 204 of the fan clipper 203 are removed from the apertures 202 of the fan 201 to detach the fan clipper 203 from the fan 201. The fan 201 in the fan module of the preferred embodiment of the present invention has four apertures in both sides, respectively, so the fan clipper 203 has four corresponding protuberances in both sides, respectively.

According to the aforementioned description, the advantages of the present invention are as follows. First, a fan is easily installed and removed in the present invention. Next, no screws are used in the present invention, so the free space can be used efficiently.

As is understood by a person skilled in the art, the foregoing preferred embodiments of the present invention are illustrative of the present invention rather than limiting of the present invention. It is intended that various modifications and similar arrangements be covered within the spirit and scope of the appended claims, the scope of which should be accorded the broadest interpretation so as to encompass all such modifications and similar structures.

What is claimed is:

1. A fan-fastening device, suitable for fastening a fan, wherein the fan has a plurality of apertures in two sides, respectively, the fan-fastening device comprising:

at least a fan clipper, wherein the fan clipper comprises:

a plurality of protuberances passing through the apertures of the fan to attach the fan clipper to one side of the fan; and at least a pressing part extending outwards from the fan clipper, wherein the pressing part is deformed by pressing, deformation of the pressing part removes the protuberances from the apertures of the fan, and the fan clipper is thereby detached from the fan.

2. The fan-fastening device according to claim 1, wherein the material of the fan clipper is plastic.

3. The fan-fastening device according to claim 1, wherein the apertures are eight in number.

4. The fan-fastening device according to claim 1, wherein the protuberances are four in number.

5. A fan module, comprising:

a fan, wherein the fan has a plurality of apertures in two sides, respectively; and a plurality of fan-fastening devices, wherein each of the fan-fastening devices comprises:

a plurality of protuberances passing through the apertures of the fan to attach the fan-fastening devices to two sides of the fan; and at least a pressing part extending outwards from the fan-fastening device, wherein the pressing part is deformed by pressing, deformation of the pressing part removes the protuberances from the apertures of the fan, and the fan-fastening devices are thereby detached from the fan.

6. The fan module according to claim 5, wherein the fan-fastening devices are plastic.

7. The fan module according to claim 5, wherein the apertures are eight in number.

8. The fan module according to claim 5, wherein the protuberances are eight in number.

9. A fan-fastening device, comprising:

a plurality of fan clippers, including a plurality of fixed parts and a plurality of pressing parts extending outwards from the fan clippers, wherein the fixed parts are used to fix the fan clippers to two sides of a fan, and the pressing parts are deformable by pressing for detaching the fan clippers from the fan.

10. The fan-fastening device according to claim 9, wherein the material of the fan clippers is plastic.

11. The fan-fastening device according to claim 9, wherein the fan has a plurality of apertures in two sides, respectively.

12. The fan-fastening device according to claim 11, wherein the apertures are four in number.

13. The fan-fastening device according to claim 11, wherein the fixed parts are protuberances and the protuberances go through the apertures to attach the fan clippers to two sides of the fan.

14. The fan-fastening device according to claim 13, wherein the protuberances are four in number.

* * * * *